United States Patent [19]

Erickson

[11] 4,007,954

[45] Feb. 15, 1977

[54] HOSPITAL LATCH

[75] Inventor: Lars Erickson, Clinton, Conn.

[73] Assignee: Walter Kidde & Company, Inc., Belleville, N.J.

[22] Filed: Nov. 10, 1975

[21] Appl. No.: 630,368

[52] U.S. Cl. ..... 292/165; 49/7; 70/92; 292/92; 292/DIG. 65; 292/DIG. 66

[51] Int. Cl.[2] ..... E05F 15/20

[58] Field of Search ..... 292/92, 174, 165, 167, 292/173, DIG. 66, 34, 36, DIG. 65; 70/92; 49/1, 7, 8

[56] References Cited

UNITED STATES PATENTS

| | | | |
|---|---|---|---|
| 1,721,162 | 7/1929 | Moore | 292/173 X |
| 1,847,686 | 3/1932 | Bienaime | 292/173 |
| 2,079,895 | 5/1937 | Brooks | 292/167 X |
| 2,201,444 | 5/1940 | Marsh | 292/165 |
| 3,477,754 | 11/1969 | Check | 292/165 |
| 3,811,717 | 5/1974 | Floyd | 292/92 |

*Primary Examiner*—J. Franklin Foss
*Attorney, Agent, or Firm*—DeLio and Montgomery

[57] ABSTRACT

A latch bolt mechanism of the push-pull type which includes a stop lever maintained normally in an inactive position by means of a fusible pin, the lever being adapted to drop into a position where it blocks the movement of the latch-withdrawing mechanism when the pin melts at a predetermined temperature due to a fire condition.

6 Claims, 6 Drawing Figures

HOSPITAL LATCH

The present invention relates to a latch set for hospital fire doors and the like, required to be locked shut in case of fire, which incorporates a latch bolt and a latch bolt stop lever, held in inactive position by a fusible pin and adapted to drop, when the pin melts, into a position where it prevents movement of the latch-withdrawing mechanism.

It is a common practice to provide fire doors in such structure as hospitals, hotels and factories for the purpose of closing off a given area and preventing the spread of fire from that area to other parts of the structure. In one type of lock set the latch bolt is spring biased into locking position and arranged for opening by means of a horizontally disposed bar or handle. It has been found that heat may render the bolt spring ineffective and permit the weight of the bar or handle to effect its movement and the retraction of the latch bolt. A type of lock set in which the problem just described is overcome is disclosed in Floyd & Erickson U.S. Pat. No. 3,811,717, May 21, 1974, on which the present invention is an improvement. In the cited patent the lock set is provided with a latch bolt stop lever which is maintained in ineffective position by a fusible pin but which can drop into a bolt head engaging position when the pin melts, the bolt actuating mechanism being of the type wherein a handle is turned to rotate a shaft passing through the door, the shaft carrying a member which engages the tail piece of the bolt to retract the latter.

It is an object of the present invention to adapt a stop lever mechanism to the push-pull type of latch bolt lock set.

It is another object of the invention to provide a stop lever which prevents movement of the latch-withdrawing mechanism without directly engaging any part of the latch bolt.

It is a further object of the invention to provide a lock set having the foregoing characteristics wherein certain parts are reversible for use in right hand doors or left hand doors without substitution of alternative parts.

It is yet another object of the invention to provide certain improvements in the form, construction and arrangement of the several parts whereby the above-named and other objects may effectively be achieved.

The invention accordingly comprises the features of construction, combination of elements, and arrangement of parts which will be exemplified in the construction hereinafter set forth, and the scope of the invention will be indicated in the claims.

A practical embodiment of the invention is shown in the accompanying drawings, wherein.

Figure 1:
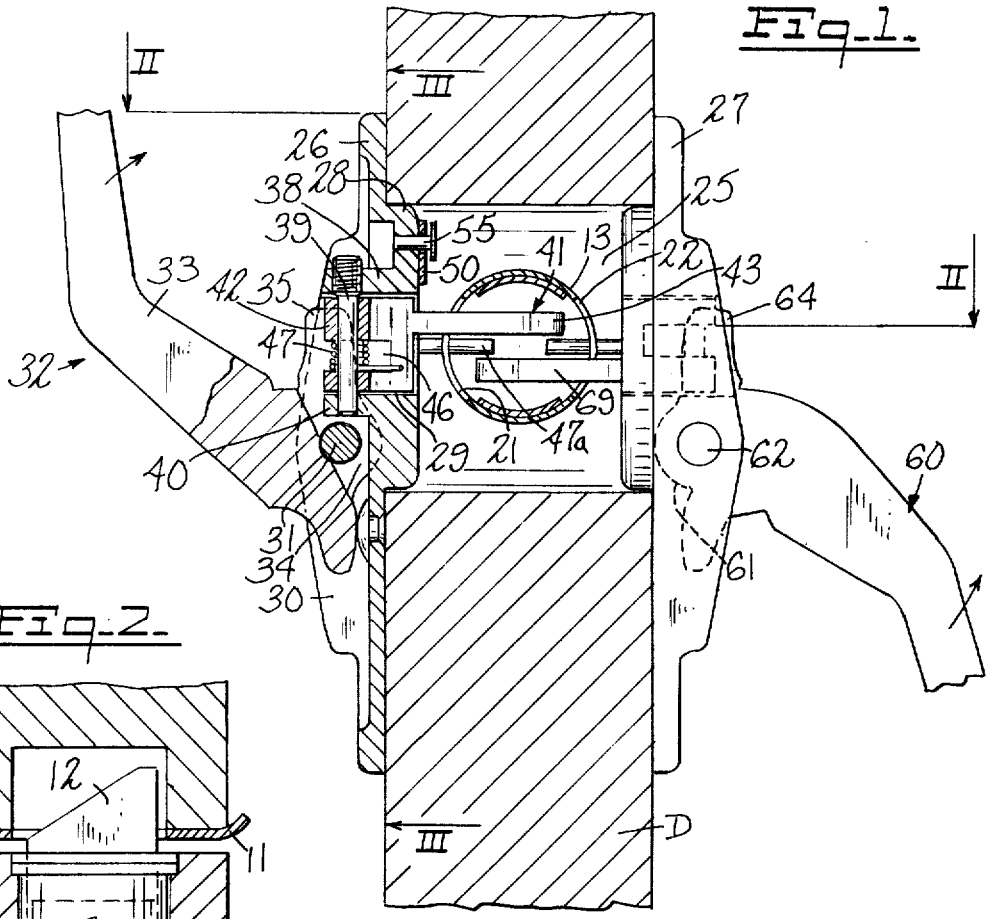
FIG. 1 represents a vertical section through a right handed door equipped with a push-pull lock set, parts being in elevation.

Referring to the drawings, a door D is mounted in association with the jamb J which is provided with a strike 11 adapted to be engaged by the latch bolt 12. The bolt is shown as being slidable in a tubular housing 13 which is fitted in a cylindrical bore 14 extending horizontally inward from the edge of the door. The body 15 of the latch bolt is tubular and its rear end portion forms a chamber between the closed rear end 16 of the housing and a tail plate 17 fixed in the body 15 at a point spaced from its rear end, the latch spring 20 being located in the chamber and bearing on the housing end 16 and plate 17 to urge the latch bolt into closed position. Both the housing and the latch bolt body are cut away laterally on both sides, as shown at 21, 22 to expose the tail plate for operative engagement by the handle actuated cams. A pin 23 extends diametrically across the housing 13 through elongated slots 24 in the body 15 of the latch bolt, to maintain the latter in proper orientation.

Opposite the openings 21, 22 the door is traversed from face to face by a circular opening 25 into each end of which is fitted a handle chassis. As illustrated, the chassis 26 at the left of FIGS. 1 and 2 is the push handle chassis and the chassis 27 at the right of FIGS. 1 and 2 is the pull handle chassis.

The chassis 26 is a rectangular plate having a raised circular boss 28 on its inner face, dimentioned to be received in the corresponding end of the opening 25 and provided with a rectangular window 29. At each side the chassis is provided with vertically elongated flanges 30, bored to receive the main pivot 31 for the handle 32. The handle comprises the lever 33 extending outward and upward, the hub position 34, traversed by the pivot 30 and drive finger 35, 36 projecting upward from the hub portion and separated by the vertical gap 37. Above the drive fingers the chassis is provided with a horizontal flange 38 in the center of which is mounted the cam pivot screw 39, the lower end of which is supported in a lug 40 which projects into the gap 37 from the midpoint of the lower edge of the window 29.

Figure 2:
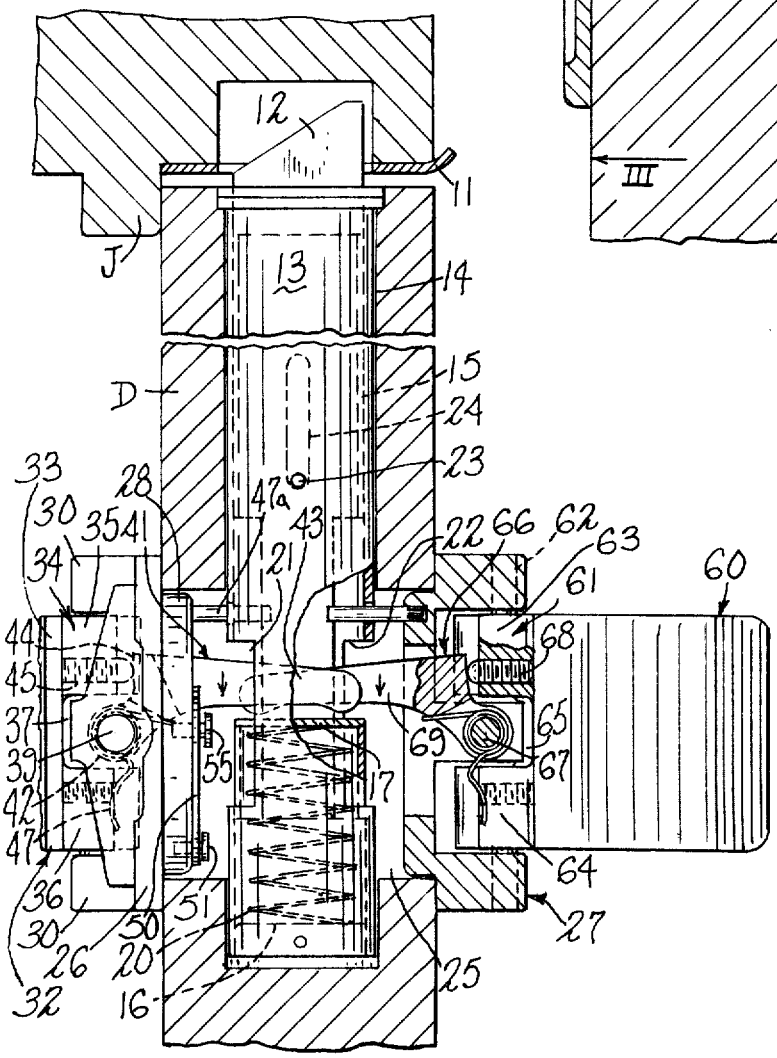
FIG. 2 represents a horizontal section on the line II—II of FIG. 1.

The latch bolt actuating cam 41 includes a post portion 42, pivoted on the screw 39 and the cam lever 43 projecting inward from the window 29 into a position adjacent the tail plate 17 (FIG. 2). The cam has a surface 44 adapted to be contacted by the end of an adjusting screw 45 in the adjacent drive finger 35, so that movement of the drive finger will rotate the cam about its pivot 39. The post portion 42 of the cam is cut away at 46 to accommodate a coil spring 47 which biases the surface 44 toward the screw 45. The drive finger 36 is also provided with an adjusting screw so that each handle can be used in right hand or left hand doors, as may be required. A pin 47*a* extends inward from the chassis through a hole in the housing 13 to ensure proper alignment of the parts.

Figure 3:
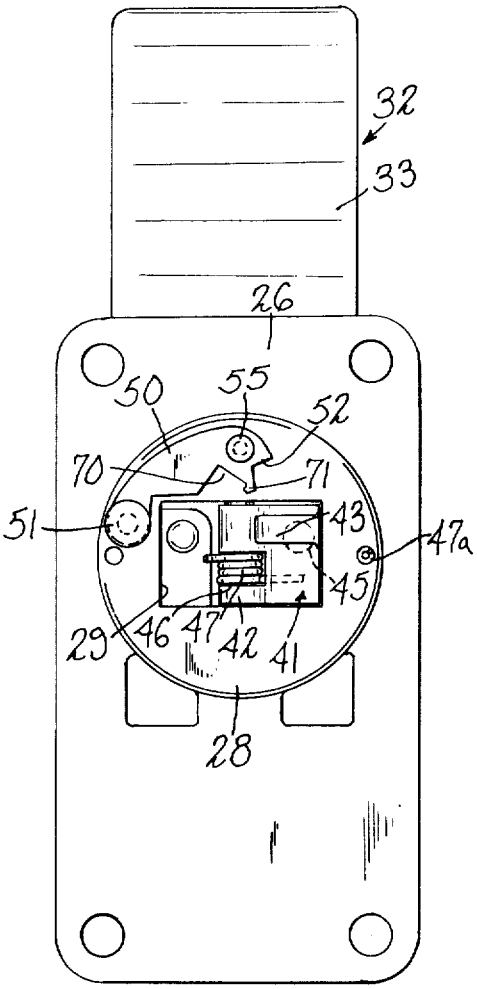
FIG. 3 represents an elevation of the push handle chassis for a right handed door with the stop lever in inactive position, as viewed from the direction of the arrows III—III in FIG. 1.
Figure 4:
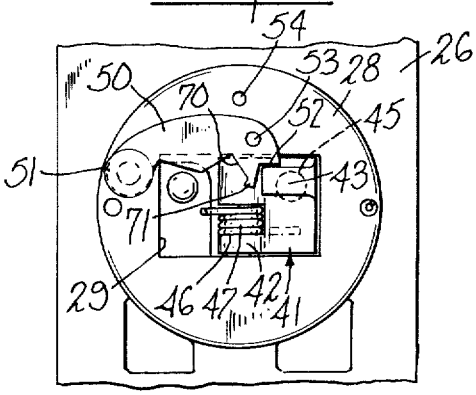
FIG. 4 represents a detail elevation of the stop lever shown in FIG. 3 dropped to its stop position.

The fire stop lever 50 is constituted by a substantially flat steel plate in the nature of a pawl, pivotally supported on the pin 51 on the inner face of the boss 28 adjacent an upper corner of the window 29. As shown in FIGS. 3 and 4, the free end of the lever is cut away to form a recess 52 which, in locking position (FIG. 4) fits freely on the cam lever 43. Adjacent the recess 52 the lever is provided with a hole 53, adapted to register with the hole 54 in the boss 28 and to receive the fusible pin 55 which, when engaged in both holes 53, 54 holds the fire stop lever in inactive position out of the path of the cam lever (FIG. 3).

From the foregoing it will be apparent that, with the door latched as shown in FIG. 2, pushing on the handle 32 will cause the screw 45 in drive finger 35 to move against the surface 44, rotating the cam to move its lever 43 against the tail plate 17, so that the latch bolt is withdrawn and the door can be opened by continued pressure in the same direction. In case of fire, when the door must be locked to restrict the burning area, heating of the mechanism to a predetermined degree will melt the pin 55, permitting the fire stop lever to drop to the position of FIG. 4 where it locks the cam lever against latch releasing movement. The door will remain latched, regardless of the effectiveness of the spring 20 since there is no force tending to unlatch it. The door will also remain latched even if falling debris, incidental to the fire, were to fall against the push handle, or if it should be hit by the stream from a fire hose.

Figure 5:
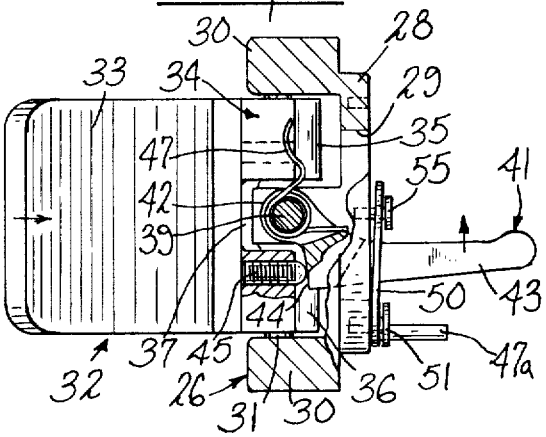
FIG. 5 represents a horizontal section through the push handle chassis for a left handed door with latch actuating elements and stop lever mounted thereon.
Figure 6:
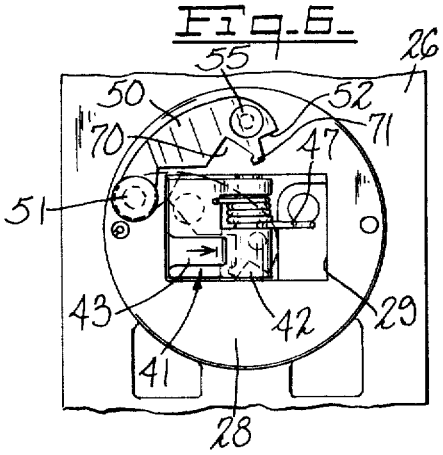
FIG. 6 represents a detail elevation of a portion of the push handle chassis with the stop lever in inactive position, its stop position being indicated in broken lines.

For use in a left hand door the parts are arranged as shown in FIGS. 5 and 6, the cam 43 being inverted, as compared to FIGS. 1 and 4 so that pushing on the lever 32 moves it in the direction of the arrows, i.e., upward in FIG. 5, to the right in FIG. 6. In order to stop movement in that direction the stop lever 50 is formed with a lower recess 70 terminating in a hook portion 71, the lever being adapted to drop to the broken line position shown in FIG. 6 where it can catch the lever 43 and prevent the unlatching movement thereof. The pivot pin 51, holes 53, 54 and fusible pin 55 are the same as described above, and the operation when exposed to fusing heat is also the same.

Opposite the push handle chassis 26 is the pull handle chassis 27 which is similar in form and construction and supports a pull handle comprising the lever portion 60 extending outward and downward from the hub portion 61, traversed by the pivot 62, and having drive fingers 63, 64 projecting upward from the hub portion and separated by the gap 65. The latch bolt actuating cam 66 is substantially identical with the cam 41 but inverted and mounted so that it can be pivoted around the cam pivot screw 67 by movement of the adjusting screw 68 in the drive finger 63, the cam lever 69 thus acting on the tail plate 17 for retracting the latch. In the cam 41 the lever 43 is above the center of the cam (FIGS. 3 and 4) whereas in the cam 66 (cam 41 inverted) the lever 69 is below the center, so that the cams can operate witout interference (FIG. 1). In the present embodiment, the pull handle is operable against the force of gravity and therefore requires no fire stop lever to block its operation against the tail plate 17, and so to cause inadvertant movement of the latch bolt.

The fire stop lever 50 is preferably bent slightly out of its original flat form, as shown in FIG. 5, in order that the free end portion may lie more or less out of contact with the adjacent surfaces of the chassis; the latter are normally brass castings or the like which may have a somewhat rough surface and the dropping of the lever could be impeded by close contact with such a surface.

A practical and economical feature of the lock set shown is the fact that the chassis plates and the cams may be identical and interchangeable, as well as being adapted for use with either right hand or left hand doors, a left hand door arrangement being shown in FIGS. 5 and 6. The stop lever 50 is also adaptable for use in left hand or right hand doors.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

What I claim is:

1. In a latch bolt mechanism of the push-pull type for fire doors, said mechanism having a latch bolt slidable in a housing and handle actuated cams engageable with the bolt for retraction thereof upon actuation of either handle, a lever pivotally supported at one end and having its other end adapted to engage the push handle cam to prevent bolt retracting movement thereof and fusible means for holding said cam engaging means in inactive position.

2. A mechanism according to claim 1 which includes chassis elements in which the cams are supported for horizontal movement around vertical axes and wherein the cam engaging lever is pivotally supported at one end on a surface of said chassis element to lie above the paths of movement of said cams.

3. A mechanism according to claim 1 wherein the cam engaging lever is provided with a hook portion adjacent its other end.

4. In a latch bolt mechanism for fire doors, said mechanism having a latch bolt slidable in a housing, a chassis element fixed to the door, a handle actuated cam engageable with the bolt for retraction thereof, said cam being supported in the chassis for horizontal movement around a vertical axis, a lever pivotally supported on the chassis at one end and provided with a hook portion adjacent its other end for engaging said cam to prevent bolt retracting movement thereof and fusible means for holding said cam engaging means in inactive position.

5. A mechanism according to claim 1 wherein the cam engaging lever is provided with a cam motion stopping recess adjacent its other end.

6. A mechanism according to claim 4 wherein the cam engaging lever is provided with a cam motion stopping recess adjacent its other end and the hook portion is adjacent said recess.

* * * * *